US007673979B2

(12) United States Patent
Rohde

(10) Patent No.: US 7,673,979 B2
(45) Date of Patent: Mar. 9, 2010

(54) INK-JET PRINTING DEVICE INCLUDING A MICROWAVE HEATING DEVICE

(75) Inventor: Domingo Rohde, Kiel (DE)

(73) Assignee: Eastman Kodak Company, Rochester, NY (US)

( * ) Notice: Subject to any disclaimer, the term of this patent is extended or adjusted under 35 U.S.C. 154(b) by 451 days.

(21) Appl. No.: 11/681,328

(22) Filed: Mar. 2, 2007

(65) Prior Publication Data

US 2007/0211127 A1 Sep. 13, 2007

(30) Foreign Application Priority Data

Mar. 3, 2006 (DE) ..... 10 2006 010 401

(51) Int. Cl.
*B41J 2/01* (2006.01)

(52) U.S. Cl. ..... 347/102

(58) Field of Classification Search ..... 347/102
See application file for complete search history.

(56) References Cited

U.S. PATENT DOCUMENTS 4,282,887 A 8/1981 Sterzer
6,663,239 B2 * 12/2003 Wotton et al. ..... 347/102

FOREIGN PATENT DOCUMENTS

WO WO01/89835 11/2001

* cited by examiner

*Primary Examiner*—Julian D Huffman

(57) ABSTRACT

A device and a method for improving the quality of prints using a printer with at least one ink-jet printing device for colored printing of a printing material, such as a continuous roll feed material, said printing device including a heating device that applies microwaves to the printing material in order to dry a print applied to the printing material.

19 Claims, 1 Drawing Sheet

INK-JET PRINTING DEVICE INCLUDING A MICROWAVE HEATING DEVICE

FIELD OF THE INVENTION

The invention relates generally to the field of swath-type printing, such as inkjet printing, and more particularly to an ink-jet printing device for colored printing of a printing material, such as a roll printing material that is to be processed continuously. The printing device having a heating device that applies microwaves to the printing material in order to dry a print applied to the printing material.

BACKGROUND OF THE INVENTION

Inkjet printing is a non-impact method for producing images by the deposition of ink droplets in a pixel-by-pixel manner onto an image-recording element in response to digital signals. There are various methods that may be utilized to control the deposition of ink droplets on the receiver member to yield the desired image. In one process, known as drop-on-demand inkjet printing, individual droplets are ejected as needed onto the recording medium to form the desired image. Common methods of controlling the ejection of ink droplets in drop-on-demand printing include piezoelectric transducers and thermal bubble formation using heated actuators. With regard to heated actuators, a heater placed at a convenient location within the nozzle or at the nozzle opening heats ink in the nozzle to form a vapor bubble that causes a drop to be ejected to the recording medium in accordance with image data. With respect to piezoelectric actuators, piezoelectric material is used in conjunction with each nozzle and this material possesses the property such that an electrical field when applied thereto induces mechanical stresses therein causing a drop to be selectively ejected from the nozzle selected for actuation. The image data provides signals to the printhead determining which of the nozzles are to be selected for ejecting an ink drop, such that each nozzle ejects an ink drop at a specific pixel location on a receiver sheet.

After the ink drop is ejected onto the printing material, it must be dried but that creates numerous problems. Ink that is used for printing with an ink jet is a very thin liquid and contains, for example, a relatively high percentage of water, for example 95%. Therefore, when printing, a very high proportion of moisture is applied to the printing material, this moisture being absorbed by the printing material only with difficulty and only up to a certain limit, before said material ultimately will even tear. Roughly speaking, this absorption limit decreases as the quality and the price of the printing material decrease. Therefore, high-quality and expensive printing materials are particularly suitable in ink-jet printing, for example, printing materials having surface coatings. In particular, in commercially operated roll printing machines, which print, for example, up to 200 running meters of printing material per minute using an ink-jet process, such an expensive printing material frequently represents too high a cost factor for the operator or for the customer.

Additionally, it is possible a customer may want to use a number of different specific printing materials to achieve a particular effect, such as those that can be used in an offset printing process which due to the above described problems might not be suitable for the inkjet printing process. If such a printing material, which cannot absorb enough moisture, is to be used, the moisture applied during the printing process must necessarily be reduced; this means, that also a lower quantity of dye must be used, because, for example, the ratio of water to dye must remain constant at 95% in order to maintain processability in an ink-jet printhead. Therefore, only the overall amount of ink for an individual print job can be reduced; however, this automatically leads to a loss of quality of the printed image, because only a lower color density can be achieved, and thus the color in the printed image remains paler. This is a particularly critical problem in multi-color printing, where sufficient color density should be achieved for each color separation, but where, for this reason, the limit of moisture saturation of the printing material used is reached particularly rapidly.

This device and related method is directed to solving this problem of drying an ink drop while still maintaining the desired color density and quality by using the microwave heating element described below.

SUMMARY OF THE INVENTION

In accordance with an object of the invention, both a device and a method are provided for improving the quality of prints using a microwave drying device in conjunction with an ink-jet printhead moving line-by-line across the printing material and including several ink pods is used to print a multi-color printing image on the printing material, and a heating device following the printhead is used to apply microwaves to the printing material to dry said printing image.

An object of the invention is an ink-jet printing device including the microwave device in such that the ink-jet printing process is less dependent on the quality of the printing material, and that the quality of printing, in particular a color density, is obtained or even improved by being less dependent on the type of the printing material in the ink-jet printing process, and that, in addition, the completion of a print is accelerated. The heating device includes at least one microwave applicator, said applicator being arranged essentially within an ink-jet impact zone. This invention further provides a configuration which integrates a printing unit and a drying step to such an extent that drying of the ink starts already as soon as the ink impinges on the printing material.

While the specification concludes with claims particularly pointing out and distinctly claiming the subject matter of the present invention, it is believed the invention will be better understood from the following detailed description when taken in conjunction with the accompanying drawings.

DETAILED DESCRIPTION OF THE INVENTION

The present description will be directed in particular to elements forming part of, or cooperating more directly with, apparatus and methods in accordance with the present invention. It is to be understood that elements not specifically shown or described may take various forms well known to those skilled in the art. The invention relates to an ink-jet printing device for colored printing of a printing material, such as a roll of continuous feed printing material to be processed, said printing device including a heating device that applies microwaves to the printing material in order to dry a print applied to the printing material. A device of the aforementioned type is basically known from document WO 01/89835 A2.

There, an ink-jet printhead moving line-by-line across the printing material and including several ink pods is used to print a multi-color printing image on the printing material, and a heating device following the printhead is used to apply microwaves to the printing material to dry said printing image.

This device is useful in conjunction with a printing material which cannot absorb enough moisture. Since the moisture applied during the printing process must necessarily be reduced; usually this means, that also a lower quantity of dye must be used, because, for example, the ratio of water to dye must remain constant at 95% in order to maintain processability in an ink-jet printhead. Therefore, only the overall amount of ink for an individual print job can be reduced; however, this automatically leads to a loss of quality of the printed image, because only a lower color density can be achieved, and thus the color in the printed image remains paler. This is particularly critical in multi-color printing, where sufficient color density should be achieved for each color separation, but where, for this reason, the limit of moisture saturation of the printing material used is reached particularly rapidly.

The object of the invention is to continue to develop an ink-jet printing device of the aforementioned type in such a manner that the ink-jet printing process becomes less dependent on the quality of the printing material, and that the quality of printing, in particular a color density, is obtained or even improved by being less dependent on the type of the printing material in the ink-jet printing process, and that, in addition, the completion of a print is possibly accelerated. In accordance with the invention, this object is achieved in that the heating device comprises at least one microwave applicator, said applicator being arranged essentially within an ink-jet impact zone.

Figure 1:
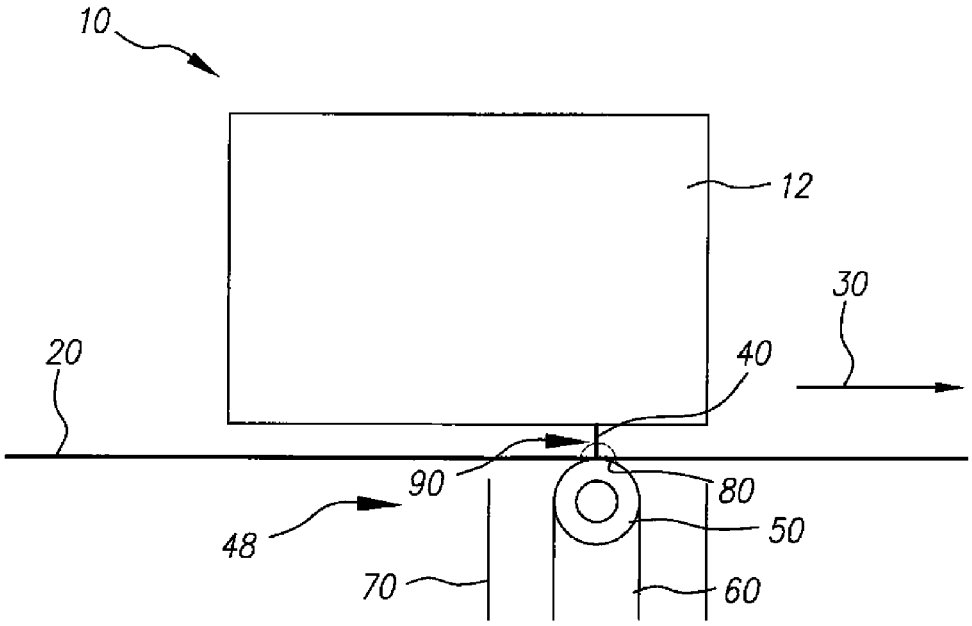
FIG. 1 shows an inkjet printer with a printhead supporting a plurality of dot forming elements and a heating device.

FIG. 1, shows a ink-jet printing device 10 that incorporates a printing system in accordance with the methods and systems described below and with reference to commonly assigned U.S. Pat. No. 4,282,887. FIG. 1 is a schematic sectional side elevation of an embodiment of the printing device 10 including an inkjet printhead 12 including dot forming elements that include devices such as inkjet nozzles 40 mounted on carriage facing the recording medium or printing material 20, and also referred to generically as a page, paper, media, or receiver 20, also referred to as a substrate.

FIG. 1 shows a box to indicate the ink-jet printhead 12 in a schematic manner. Underneath this printhead 12, the continuous printing material 20 is transported in a transport direction 30. This printing material 20 is printed by the printhead 12 by means of the ink jet nozzle 40. Underneath the printing material plane, is the heating device 48 including a printing material transport roller or printing material guide roller 50 is indicated, said roller carrying, supporting and advancing the printing material 20. The roller has a perforate shell 50 that may be uneven, also referred to as a "ridged element", that acts as a hollow guide 80 in a microwave applicator 60, in particular, the hollow guide 80 focuses or guides the microwave to be applied or directed essentially in a zone 90 of the impinging ink jet nozzle 40. In so doing, the microwave is applied in order to dry the ink of the ink jet 40 as quickly and as completely as possible on the printing material 20. In addition, the microwave applicator 60 may be enclosed by a choke structure 70. In order to provide a better overview, the distances between this choke structure and the printhead 12 have been depicted on an exaggerated scale.

The ink-jet printing device and related method described below allows the ink-jet printing process to be less dependent on the quality of the printing material, and that the quality of printing, in particular a color density, is obtained or even improved by being less dependent on the type of the printing material in the ink-jet printing process, and that, in addition, the completion of a print is accelerated. This is achieved in that the heating device comprises at least one microwave applicator, said applicator being arranged essentially within an ink-jet impact zone. The configuration integrates a printing unit and a drying step to such an extent that drying of the ink starts already as soon as the ink impinges on the printing material. In regard to structural engineering aspects, a modification of the invention in this configuration advantageously provides that a part of the space underneath an ink-jet printhead of a printing machine be used for this purpose. To achieve this, a microwave applicator is arranged beneath the nozzles of the printhead in such a manner that the printing material can be transported between the nozzles and the applicator.

The heating device includes at least one structured, so-called ridged microwave applicator, whereby, the applicator structure focuses the electrical field of the microwave essentially in the ink-jet impact zone. The prior-art document U.S. Pat. No. 4,282,887 can serve as a basic reference for a structured microwave applicator or hollow conductor and substantiate the use of the English-language term "ridged" in conjunction with this.

As shown in FIG. 1, in accordance with the invention, it is particularly advantageous to incorporate the printing material transport roller 50 that is made of a metal as a structure in the microwave applicator 60.

Another modification of the invention is characterized in that the microwave applicator is provided and set up for a moving microwave. A so-called "traveling wave" device is particularly advantageous because it achieves a largely uniform heating across the width of the applicator, however, the coupling efficiency is lower than in resonance-type systems. One advantage of the present invention is that microwave radiation is applied to the ink immediately after the ink has impinged on the printing material, specifically paper. In this first moment, the ink is still present in mostly liquid form, which, on one hand, increases the coupling efficiency and, on the other hand, counteracts the penetration of moisture into the deeper layers of the paper. This increases the optical density of the prints, and the deformation of paper due to the penetrating effect of moisture is further reduced. However in high-speed systems, this can be used only as an additional measure, because in these systems this might mean that not enough energy can be applied to achieve mostly complete drying.

This method can be used with an existing printing machine by implementing and retrofitting a (first) dryer step without extensive re-design measures. In accordance with the invention, instead of a traveling microwave, at least one magnetron can also be provided as the microwave source, and the microwave heating device can comprise at least one resonator, through which the printing material is guided on a transport path and which is provided for generating stationary microwaves. However, it is also possible to use more than one resonator and the maxima of the resonators can be offset with respect to each other by the hollow-conductor wavelength $\lambda$ divided by twice the number of resonators.

Generally, N resonators can be arranged in series. In these resonators, stationary microwaves having a so-called hollow waveguide wavelength $\lambda$ are generated, said wavelength also being a function of the geometric data of a used hollow waveguide. Therefore, the hollow waveguide wavelength does not simply satisfy the known formula $c=\lambda \cdot v$ where c represents the velocity of the electromagnetic waves and v represents the frequency of the used waves of the computable wave length λ. Each wave progression leads to regions of varying field strength in the plane of the printing material, with respect to which the stationary wave progresses essentially in parallel. Of course, in a strict sense, the field strength progression is continuous. The maxima regions of successive resonators are offset with respect to each other, preferably in a direction transverse to the transport direction of the printing material, in particular, with the use of preferably two resonators, offset by λ/4 with respect to each other, which, in the general case, corresponds to an offset of respectively λ/2N with the use of N resonators, whereby for two resonators N=2. The offset arrangement of stationary microwaves, or of field strength progressions in the resonators, advantageously results in particularly uniform and homogenous heating of the area to which microwaves are applied. It is by all means conceivable that, instead of two resonators, four resonators (N=4), or two times two resonators, configured as two successive quasi-independent heating arrangements, are used in series (N=2). Here too, a corresponding number of magnetrons can be provided as microwave sources, or the power output can be distributed by means of power splitters.

The transition region between a paper guide roller and a holder must be configured so as to be sealed relative to microwave radiation. To do so, sliding contacts are used between the two components in the transition region. This principle of the first drying step can be applied also to slower ink-jet applications. In so doing, depending on the requirements of process speed and applied quantity of ink, it is also possible to achieve complete drying with only one drying step.

The width of the microwave applicator along the transport path of the printing material is chosen as small as possible in order to facilitate handling of the printing material and chosen large enough in order to keep the electrical field in the resonator below the air breakdown voltage. In one embodiment the microwave applicator has a width of approximately 1 centimeter to approximately 10 centimeters.

Figure 2:
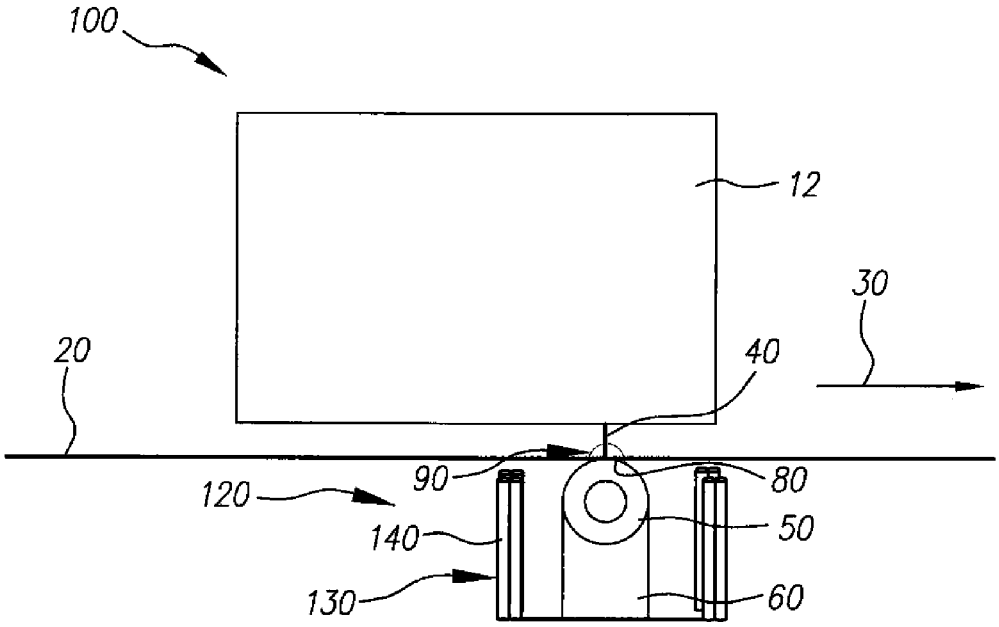
FIG. 2 shows an inkjet printer with one embodiment of a heating device.

A further modification of the inventive device provides that a ventilation and venting system is provided in the zone where microwaves are applied. FIG. 2 shows an inkjet printer 100 with a heating device 120 provides that, in order to shield the microwaves of the heating device, a so-called choke structure 130 is provided. Scattered radiation exiting from the resonators through passage openings for the printing material can be reduced by setting up such a choke structure 130 and/or by using absorbent materials outside the resonator. To do so, this embodiment provides that the choke structure 130 including essentially rod-shaped choke elements 140 arranged at regular distances from each other, whereby said rod-shaped choke elements 140 are arranged in double rows and either are arranged in line with each other or exactly offset with respect to each other. The cross-section of the rod shape may be round or angular.

The regions of the choke structure 130 can also be very well utilized as regions for ventilation and deventilation and cooling of the printing material, in that air inlet and air outlet openings are provided in these regions that are connected to an air duct system. Basically, air holes in the resonator regions are not critical, when they have a diameter of less than or equal to 3 millimeters. A ventilation and deventilation in the region of the resonator itself, in particular, in the choke structure, may be provided to supplement a downstream ventilation and deventilation system; advantageously, this can also be used to achieve an integral solution, thereby creating a compact design which combines heating, ventilation and cooling in an interfacing manner. The mentioned "holes" may be configured as nozzles to form an air jet, or nozzles may be provided.

The embodiment shown in FIG. 2 could result in additional inventive features, to which, however, the scope of the invention is not restricted, is shown by and explained with reference to the figure. FIG. 2 shows a box to indicate the ink-jet printhead 12 in a schematic manner. Underneath this printhead 12, the continuous printing material 20 is transported in the transport direction 30. This printing material 20 is printed by the printhead 12 by means of the ink jet nozzle 40.

Underneath the printing material plane, the printing material transport roller or printing material guide roller 50 is indicated, said roller carrying, supporting and advancing the printing material 20 and, at the same time, in an inventively skillful way being integrated as a structured element or as a "ridged element" in the microwave applicator 60, in particular, the hollow guide 80, in order to focus the microwave to be applied exactly in the zone 90 of the impinging ink jet 40. In so doing, the microwave is applied in order to dry the ink of the ink jet 40 as quickly and as completely as possible on the printing material 20. In addition, the microwave applicator 60 may be enclosed by the choke structure 130. In order to provide a better overview, the distances between this choke structure 130 and the printhead 12 have been depicted on an exaggerated scale.

The invention has been described in detail with particular reference to certain preferred embodiments thereof, but it will be understood that variations and modifications can be effected within the spirit and scope of the invention.

The invention claimed is:

1. An ink-jet printing device for printing on a printing material transported in a transport direction, the printing device comprising:

a. an inkjet printhead defining an inkjet impact zone; and b. a heating device that applies microwaves to the printing material, wherein the heating device comprises:

i. at least one microwave applicator emitting microwaves toward an adjoining impact zone to dry the ink; and ii. a perforate shell adjoining the impact zone to guide the microwaves, wherein the perforate shell is within a roller rotated to transport the printing material.

2. The device according to claim 1, wherein the heating device comprises at least one ridged microwave applicator.

3. The device according to claim 1, wherein the perforate shell focuses the electrical field of the microwave essentially in the ink-jet impact zone.

4. The device according to claim 1, wherein the perforate shell comprises an uneven surface.

5. The device according to claim 4, wherein the perforate shell comprises ridges.

6. The device according to claim 1, wherein at least one magnetron is provided as a microwave source.

7. The device according to claim 1, wherein the heating device comprises at least one resonator, through which the printing material is guided on a transport path and which is provided for generating stationary microwaves.

8. The device according to claim 7, wherein more than one resonator is used and the maxima of the resonators are offset with respect to each other by a hollow-conductor wavelength λ divided by twice the number of resonators.

9. The device according to claim 7, wherein more than one resonator is used, one magnetron is provided for the microwave supply of more than one resonator, and that, for distributing the power of the magnetron to the resonators supplied by said magnetron, a power splitter is provided.

10. The device according to claim 7, wherein the width of the microwave applicator along the transport path of the printing material is chosen as small as possible in order to facilitate handling of the printing material and chosen large enough in order to keep the electrical field in the resonator below the air breakdown voltage.

11. The device according to claim 10, wherein the microwave applicator has a width of approximately 1 centimeter to approximately 10 centimeters.

12. The device according to claim 1, further including a ventilation and venting system provided in the zone where microwaves are applied.

13. The device according to claim 1, further including a choke structure in order to shield the microwaves of the heating device.

14. The device according to claim 13, wherein the choke structure comprises essentially rod-shaped choke elements arranged at regular distances from each other.

15. The device according to claim 13, wherein the zone of the choke structure is incorporated in a ventilation and venting system.

16. An ink-jet printing device for printing on printing material transported in a transport direction, the printing device comprising:

a. an inkjet printhead defining an inkjet impact zone; and b. a heating device that applies microwaves to the printing material, wherein the heating device comprises:

i. at least one microwave applicator emitting microwaves toward an adjoining impact zone to dry the ink;

ii. a perforate shell adjoining the impact zone to guide the microwaves, wherein the perforate shell is within a roller rotated to transport the printing material in the transport direction; and iii. a choke structure in order to shield the microwaves of the heating device.

17. The device according to claim 16, wherein the choke structure comprises essentially rod-shaped choke elements arranged at regular distances from each other.

18. The device according to claim 16, wherein the zone of the choke structure is incorporated in a ventilation and venting system.

19. A method for printing on a printing material transported in a transport direction, the method comprising:

a. defining an inkjet impact zone;

b. applying microwaves to printing material using a heating device, the heating device comprising:

i. at least one microwave applicator emitting microwaves toward an adjoining impact zone to dry the ink;

ii. a perforate shell adjoining the impact zone to guide the microwaves, wherein the perforate shell is within a roller rotated to transport the printing material in the transport direction.

* * * * *